US006805185B2

(12) United States Patent
Gravel et al.

(10) Patent No.: US 6,805,185 B2
(45) Date of Patent: Oct. 19, 2004

(54) COVER PANEL ATTACHMENT SYSTEM FOR PARTITIONS

(75) Inventors: Donald P. Gravel, Toronto (CA); Douglas L. Hancey, Richmond Hill (CA); Vladimir Zila, Toronto (CA)

(73) Assignee: Steelcase Development Corporation, Caledonia, MI (US)

( * ) Notice: Subject to any disclaimer, the term of this patent is extended or adjusted under 35 U.S.C. 154(b) by 162 days.

(21) Appl. No.: 09/827,642

(22) Filed: Apr. 6, 2001

(65) Prior Publication Data

US 2003/0041540 A1 Mar. 6, 2003

(51) Int. Cl.[7] ..... E04H 3/00

(52) U.S. Cl. ..... 160/135; 52/36.1; 52/127.6; 52/127.8; 52/243; 52/287.1; 52/476; 52/481.2; 52/483.1; 52/489.1; 52/506.05; 52/506.06; 52/582.1; 52/792.1; 52/787.1; 52/787.11; 160/369; 160/351; 160/236; D25/121

(58) Field of Search ..... 52/36.1, 127.6, 52/127.8, 238.1, 243, 287.1, 476, 481.2, 483.1, 489.1, 506.05, 506.06, 582.1, 792.1, 787.1, 787.11; 160/135, 369; D25/121

(56) References Cited

U.S. PATENT DOCUMENTS

| | | | | |
|---|---|---|---|---|
| 3,707,060 | A | | 12/1972 | Jansen, Jr. |
| 3,729,889 | A | | 5/1973 | Baruzzini |
| 3,803,787 | A | | 4/1974 | Daggy |
| 3,885,362 | A | | 5/1975 | Pollock |
| 4,028,855 | A | | 6/1977 | Prewer |
| 4,087,944 | A | | 5/1978 | Mecklenburg |
| 4,130,972 | A | | 12/1978 | Varlonga |
| 4,361,994 | A | | 12/1982 | Carver |
| 4,423,573 | A | | 1/1984 | Omholt et al. |
| 4,631,881 | A | | 12/1986 | Charman |
| 4,905,428 | A | | 3/1990 | Sykes |
| 4,961,295 | A | | 10/1990 | Kosch, Sr. et al. |
| 5,010,702 | A | | 4/1991 | Daw et al. |
| 5,062,246 | A | | 11/1991 | Sykes |
| 5,140,792 | A | | 8/1992 | Daw et al. |
| 5,408,796 | A | | 4/1995 | Hashimoto et al. |
| 5,412,912 | A | | 5/1995 | Alves |
| 5,524,402 | A | | 6/1996 | Sykes |
| 5,642,593 | A | | 7/1997 | Shieh |
| 5,746,034 | A | | 5/1998 | Luchetti et al. |
| 5,787,651 | A | | 8/1998 | Horn et al. |
| 5,791,093 | A | | 8/1998 | Diamond |
| 5,802,789 | A | | 9/1998 | Goodman et al. |
| 5,804,763 | A | | 9/1998 | Smeenge |
| 5,875,594 | A | | 3/1999 | Hellwig et al. |
| 5,941,026 | A | | 8/1999 | Eisenreich et al. |
| 6,000,180 | A | | 12/1999 | Goodman et al. |
| 6,012,258 | A | * | 1/2000 | Brown et al. ..... 52/239 |
| 6,023,899 | A | * | 2/2000 | Mecozzi ..... 52/396.04 |
| 6,141,926 | A | * | 11/2000 | Rossiter et al. ..... 52/239 |
| 6,167,664 | B1 | | 1/2001 | Reuter et al. |
| 6,202,382 | B1 | | 3/2001 | Conterno |
| 6,256,941 | B1 | * | 7/2001 | Yu et al. ..... 52/144 |
| 6,418,689 | B1 | * | 7/2002 | Hacquard et al. ..... 52/474 |

* cited by examiner

*Primary Examiner*—Carl D. Friedman
*Assistant Examiner*—Christy M. Green
(74) *Attorney, Agent, or Firm*—Price, Heneveld, Cooper, DeWitt & Litton, LLP

(57) ABSTRACT

A partition for open building space and the like having a frame including at least one substantially horizontal surface. A cover member is configured to enclose at least a portion of the frame. The cover member includes attachment members configured to connect the cover member to the frame. A seal is attached to the cover member and includes a resilient flap which engages the substantially horizontal surface of the frame to inhibit the passage of acoustical and/or optical energy through the partition.

39 Claims, 10 Drawing Sheets

COVER PANEL ATTACHMENT SYSTEM FOR PARTITIONS

BACKGROUND OF THE INVENTION

The present invention concerns a partition construction for subdividing a building space including interconnected frames and covers for the frames, and more particularly concerns a cover panel attachment system for the partitions.

In new building constructions, components of wall and partition systems are ordered so that, when interconnected and assembled, they divide the building space into a predetermined arrangement of offices, work areas, and other specialized areas. However, as businesses continue to evolve and the office area undergoes rearrangement, the components are often not as flexible as desired, such that the existing components limit the rearrangement unless new components are ordered. Such new components are expensive, delay the rearrangement, and often are not even available, such as when a particular upholstery for covering the component has been discontinued. Sometimes removable covers are used to cover partition frames. One advantage of removable covers is that, when a corner of one is damaged, it can be interchanged with a new cover, or another removable cover that is in a less visible location. However, unless all of the partition frames are the same size, the removable covers must be interchanged only with other removable covers that are the same size. In addition to the above, architects and office designers are constantly looking for novel constructions that provide novel and distinctive appearance, but that are flexible enough to accommodate both modernistic and more conservative appearance. Furthermore, removable covers allow interiors of the partitions to become accessible for routing utility, power or signal distribution systems through the partitions. However, removable covers can allow light and/or sound to pass through a wall of the partition, thereby interfering with the work environment of adjacent work areas.

Accordingly, an apparatus solving the aforementioned disadvantages and having the aforementioned advantages is desired.

SUMMARY OF THE INVENTION

One aspect of the present invention is to provide a partition for open building space and the like having a frame including at least one substantially horizontal surface. A cover member is configured to enclose at least a portion of the frame. The cover member includes attachment members configured to connect the cover member to the frame. A seal is attached to the cover member and includes a resilient flap which engages the substantially horizontal surface of the frame to inhibit the passage of acoustical and/or optical energy through the partition.

Another aspect of the present invention is to provide a cover panel for a partition of the type having a frame with a horizontal surface. The cover panel includes a cover member and a seal. The cover member is configured to enclose at least a portion of the frame. The cover member includes attachment members configured to connect the cover member to the frame. The seal is attached to the cover member, and includes a resilient flap configured to engage the horizontal surface of the frame when the cover member is connected to the frame. The seal inhibits the passage of acoustical and/or optical energy through the partition.

In yet another aspect of the present invention, a method of removing a cover member from a frame is provided. The cover member includes attachment members connecting the cover member to the frame. The attachment members include a detent for connecting a portion of the attachment members to the frame. The frame includes a flange located adjacent an edge of the cover member when the cover member is connected to the frame. The method includes the steps of providing a tool having a notch, inserting the tool between the flange and the edge of the cover member, rotating the tool such that the edge of the cover member is located within the notch of the tool, depressing the detent with the tool, and disconnecting the attachment members from the frame.

The principal objects of the present invention include providing an improved cover panel attachment system for partition panels. The cover panel attachment system allows covers having various configurations to be replaced and/or substituted for existing covers without altering the configuration of the partition frames. The cover panel attachment system also can be used to provide an acoustic and/or optical barrier for adjacent workspaces separated by the cover panel. The cover panel attachment system is efficient in use, economical to manufacture, capable of a long operable life, and particularly adapted for the proposed use.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
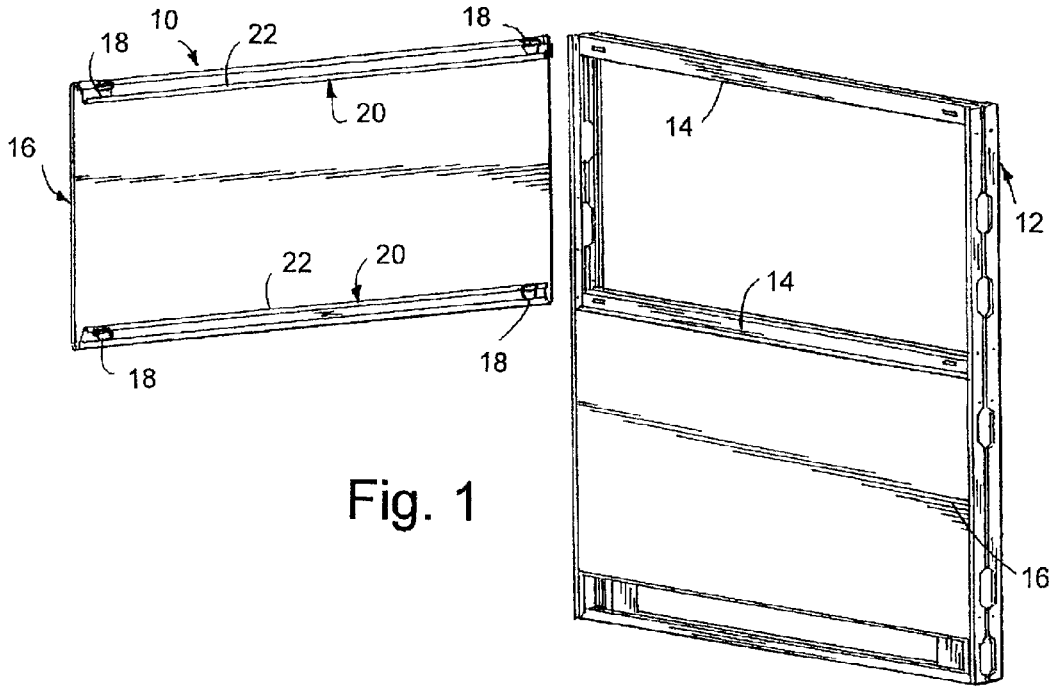
FIG. 1 is an exploded perspective view of a partition embodying the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a partition for open building space and the like embodying the present invention. In the illustrated example, the partition 10 has a frame 12 including at least one substantially horizontal surface 14. A cover member 16 is configured to enclose at least a portion of the frame 12. The cover member 16 includes attachment members 18 configured to connect the cover member 16 to the frame 12. A seal 20 is attached to the cover member 16 and includes a resilient flap 22 which engages the substantially horizontal surface 14 of the frame 12 to inhibit the passage of acoustical and/or optical energy through the partition 10.

Figure 2:
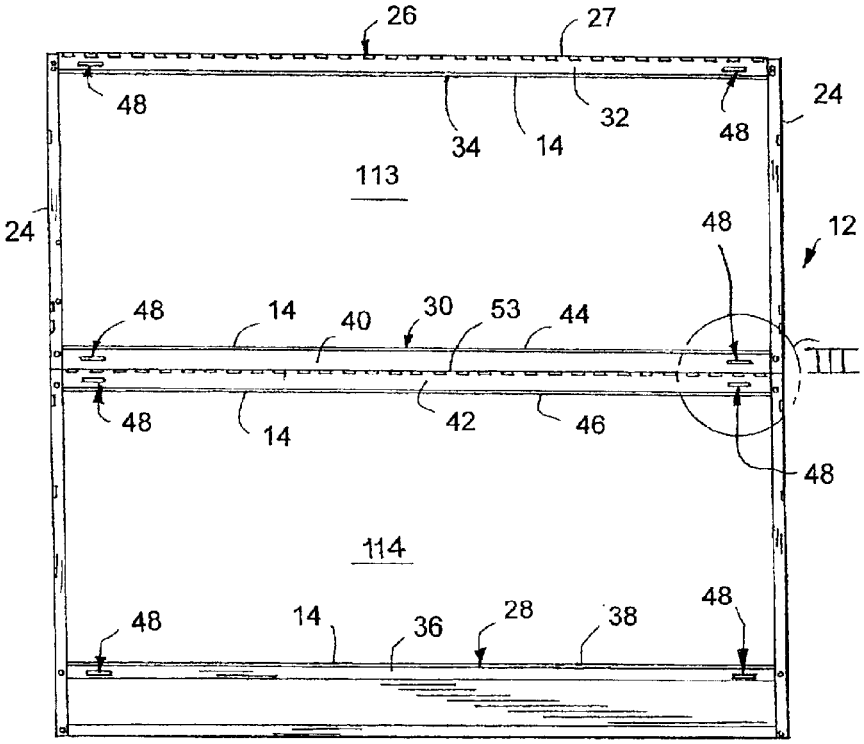
FIG. 2 is a front view of a frame of the present invention.

In the illustrated example, the frame 12 (FIG. 2) includes a pair of opposite side frame members 24, a top frame cross-member 26, a bottom frame cross-member 28 and a compound middle frame cross-member 30. The pair of opposite side frame members 24 each have a U-shaped cross section, wherein the open sides of the side frame members 24 face each other. Opposite ends of the top frame cross-member 26, the bottom frame cross-member 28 and the compound middle frame cross-member 30 are located within the open sides of both of the side frame members 24. The top frame cross-member 26 and the bottom frame cross-member 28 approximately have a rectangular cross-section and span the side frame members 24 at the top and adjacent the bottom, respectively, of the frame 12. The top frame cross-member 26 (FIGS. 2 and 14) includes a front face 32, a back face 33 and a bottom face 34. A first substantially horizontal surface 14 is located on the bottom face 34 of the top frame cross-member 26. The top frame cross-member 26 also has an inverted L-shaped flange 29 extending upward and outward above each of the front face 32 and back face 33 of the top frame cross-member 24. A top face 27 of the top frame cross-member 24 includes an elongated channel 25, which could accept a trim piece for covering the top face 27. Likewise, the bottom frame cross-member 28 includes a front face 36, a back face (opposite to the front face 36 as seen in FIG. 2) and a top face 38. A second substantially horizontal surface 14 is located on the top face 38 of the bottom frame cross-member 28. A trim piece or kick panel (not shown) is placed below the bottom frame cross-member 28 on the front and rear of the frame 12 to enclose the bottom on the frame 12.

Figure 13:
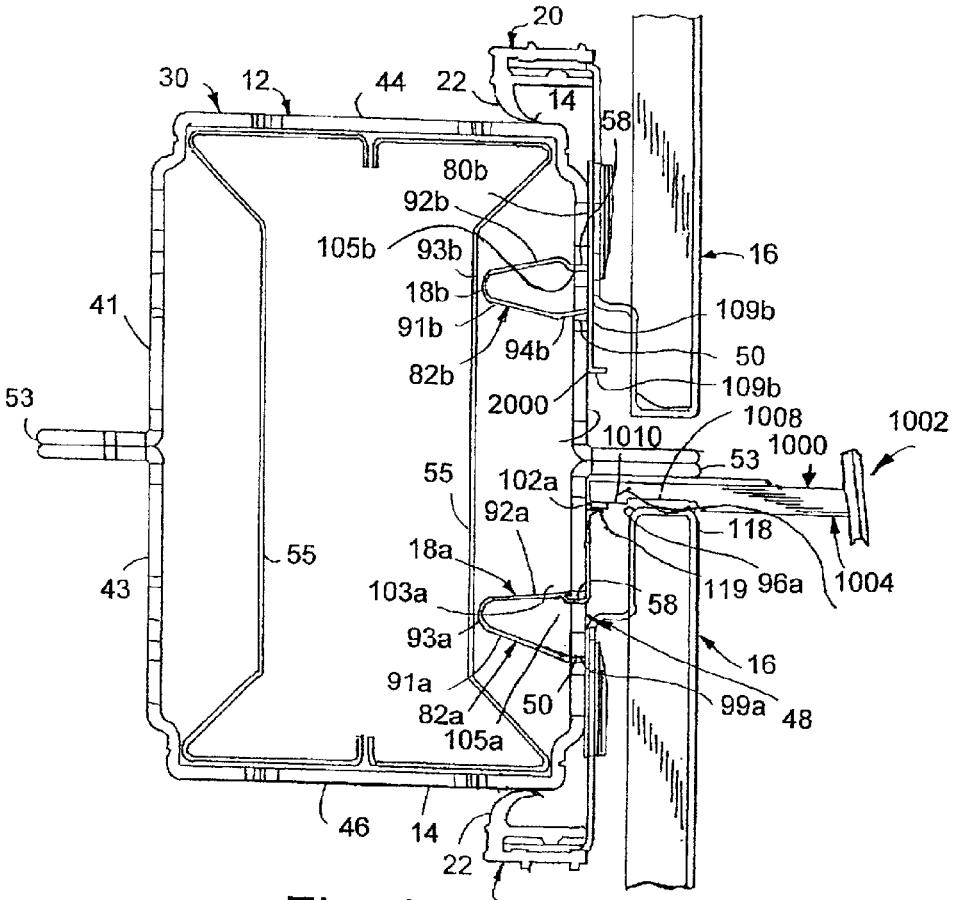
FIG. 13 is a cross-sectional partial view of the seal, a middle compound frame cross-member of the frame, the cover member and attachment members of the present invention.

The illustrated compound middle frame cross-member 30 (see FIGS. 2 and 13) has a substantially rectangular shaped cross-section. The compound middle frame cross-member 30 includes an upper front face 40, an upper back face 41, a lower front face 42 parallel to the upper front face 40, a lower back face 43 parallel to the upper back face 41, a top face 44 and a bottom face 46. The compound middle frame cross-member 30 also includes an elongated horizontal trim strip 53 extending outward between the upper front face 40 and the lower front face 42 and between the upper back face 41 and the lower back face 43. A third substantially horizontal surface 14 is located on the top face 44 and a fourth substantially horizontal surface 14 is located on the bottom face 46 of the compound middle frame cross-member 30. As shown in FIG. 13, the compound middle frame cross-member 30 includes a pair of elongate W-shaped seals 55 located within the compound middle frame cross-member 30 to provide a light and/or acoustic inhibitor between the front faces and the rear faces of the middle frame cross-member 30. As explained in more detail below, the resilient flap 22 of one seal 20 preferably engages each of the substantially horizontal surfaces 14 to provide an acoustic and/or optical barrier for the partition 10. Although a specific frame 12 configuration is herein disclosed, the frame 12 could have any number of cross members in any configuration whereby one seal 20 on the cover member 16 engages one horizontal surface 14 of the frame 12.

Figure 3:
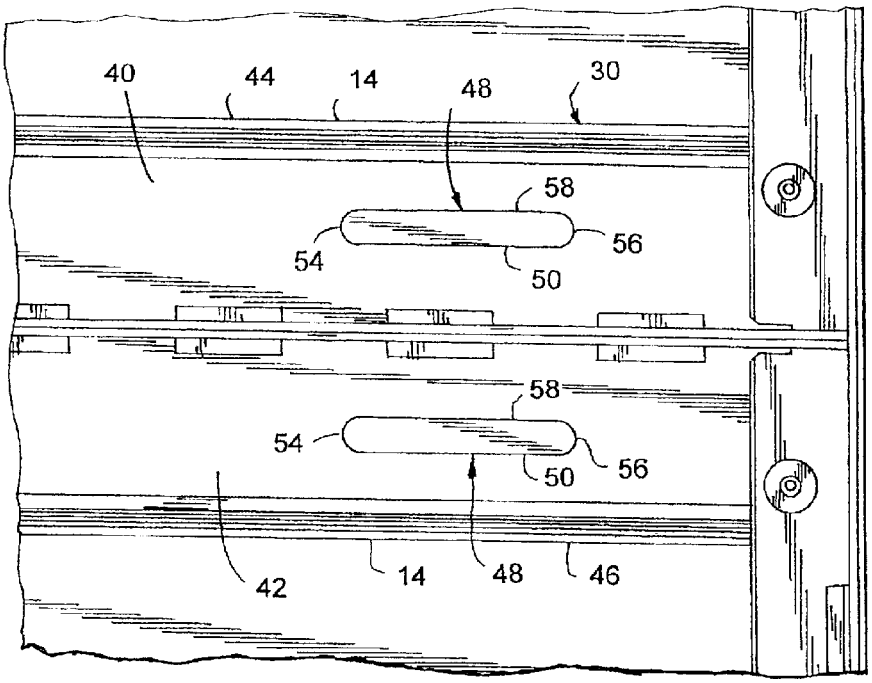
FIG. 3 is a partial front view of the frame having an oval-shaped window taken from within the circle III of FIG. 2 of the present invention.

In the preferred embodiment, the frame 12 includes an oval-shaped window 48 (FIG. 3) through opposite ends of each of the front face 32 and back face 33 of the top frame cross-member 26, the upper front face 40, the lower front face 42, the upper back face 41 and the lower back face 43 of the compound middle frame cross-member 30, and the front face 36 and the back face of the bottom frame cross-member 28. The oval-shaped window 48 includes a bottom edge 50, a first side edge 54, a second side edge 56 and a top edge 58. As explained in more detail below, each attachment member 18 is inserted into one of the oval-shaped windows 48 for removably attaching the cover members 16 to the frame 12. Although an oval-shaped window 48 is disclosed in the preferred embodiment, the window could have any configuration. For example, the windows 48 could be circular, W-shaped or any other shape, depending on the design of the attachment members 18.

Figure 4:
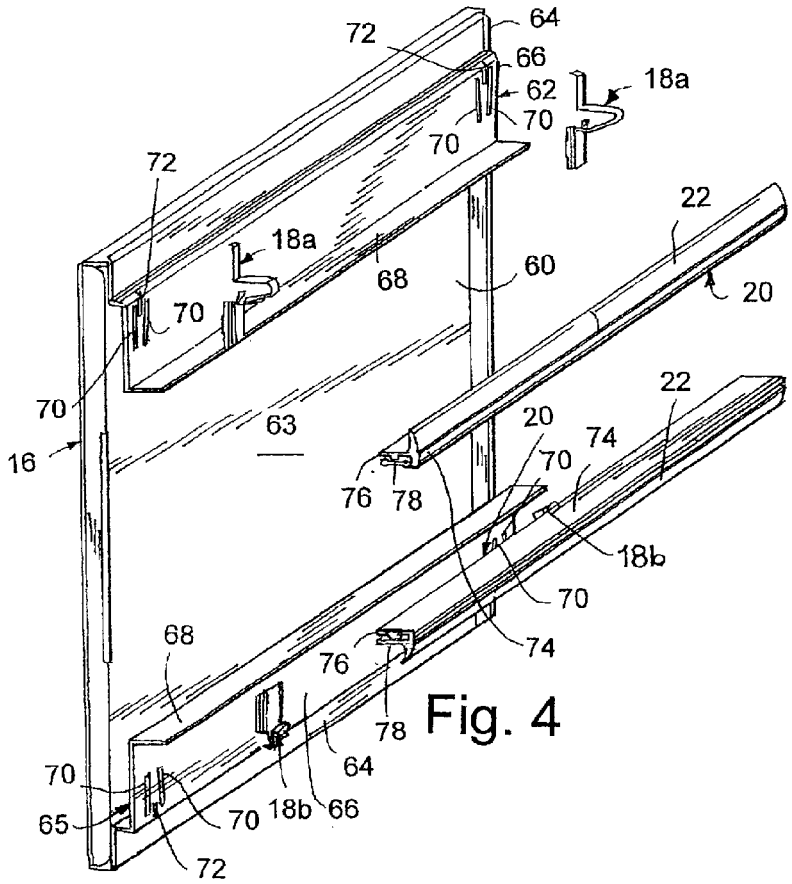
FIG. 4 is an exploded perspective view of a seal, cover member and attachment members of the present invention.
Figure 5:
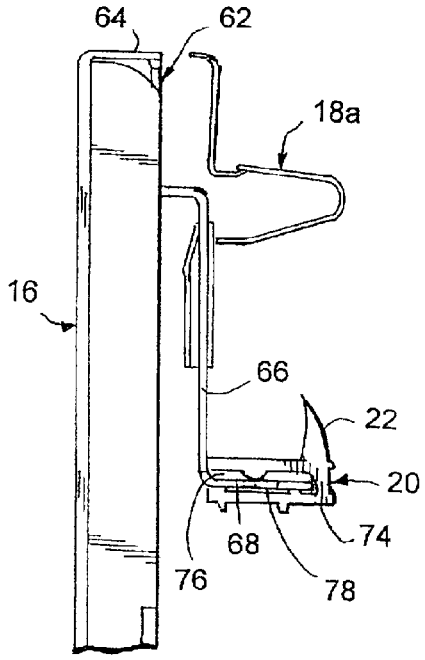
FIG. 5 is a partial side view of the cover member and seal of the present invention.
Figure 12:
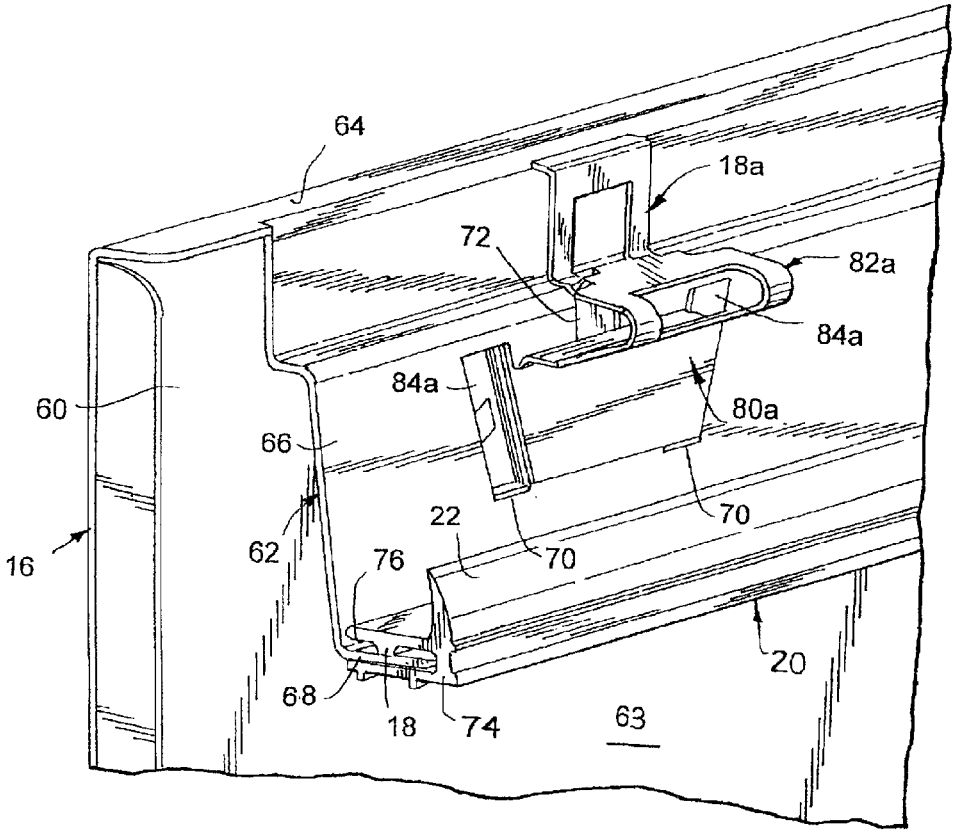
FIG. 12 is a partial rear isometric view of the seal, the cover member and the attachment member of the present invention.

In the illustrated example, the cover member 16 (FIGS. 4, 5 and 12) includes a substantially rectangular sheet 60, an upper channel member 62 and a lower channel member 65 extending from a rear face 63 of the sheet 60. The sheet 60 is preferably made out of steel, wood, or any other material that could be used to cover a partition 10. Upper attachment members **18*a* are attached to the upper channel member 62 and lower attachment members 18*b* are attached to the lower channel member 65, and thereby assist in attaching the cover member 16 to the frame. The channel members 62 and 65 are also connected to one of the seals 20. The upper channel member 62 includes an upper L-shaped flange 64, an intermediate L-shaped flange 66 and a lower flange 68. The upper L-shaped flange 64 extends along the rear face 63 of the cover member 12 and extends outwardly and downwardly from the top edge of the sheet 60. The intermediate L-shaped flange 66 extends outward and downward from the bottom edge of the upper flange 64. The lower flange 68 extends rearwardly and substantially perpendicularly from the bottom edge of the intermediate flange 66. As seen in FIG. 4, the lower channel member 65 is a mirror image to the upper channel member 62 and extends upwardly from the bottom edge of the sheet 60. The cover members 16 can be made from a variety of materials and with different coverings as commonly found on cover members 16** and well known to those skilled in the art.

In the preferred embodiment, the intermediate L-shaped flange 64 of each of the upper channel member 62 and the lower channel member 65 includes a pair of slots 70 adjacent each side edge of the intermediate L-shaped flange 64. The pair of slots 70 in the upper channel member 62 are preferably slanted downwards towards each other as they approach the bottom of a vertical surface of the intermediate L-shaped flange 64 of the upper channel member 62. Likewise, the pair of slots 70 in the lower channel member 65 are slanted upwards towards each other as they approach the top of a vertical of the intermediate L-shaped flange 64 of the lower channel member 65. Each intermediate L-shaped flange 66 also includes a short slot 72 in the horizontal surface and the vertical surface of the L-shaped intermediate flange 66 between each of the pair of slots 70. Each attachment member 18 is inserted into one of the pairs of slots 70 to connect the attachment members 18 to the cover member 16. The pair of slots 70 are preferably slanted to assist in properly orientating the attachment member 18 in the slots 70, although the slots 70 could be parallel. Furthermore, the seal 20 is connected to the lower flange 68.

The illustrated seal 20 (FIGS. 4, 5 and 12) includes an elongated body 74 having a U-shaped groove 76 and the resilient flap 22. The resilient flap 22 preferably extends from the body 74 over its length in a direction substantially perpendicular the U-shaped groove 76. The body 74 preferably includes at least one finger 78 extending into the U-shaped groove 76. Two seals 20 are connected to the cover member 16 by inserting the lower flange 68 of each of the channel members 62 and 65 into the U-shaped groove 76 of one of the seals, wherein the lower flange 68 is frictionally held within the U-shaped groove 76 with an interference fit. The finger 78 extending into the U-shaped groove 76 provides additional friction for maintaining the seal 20 on the cover member 16. It is contemplated that the seal could be attached to the cover member 16 by other means, for example, by adhesive.

When the seals 20 are placed onto the channel members 62 and 65 of the cover member 16 in the preferred embodiment, the resilient flap 22 of the seal 20 of the upper channel member 62 would face upward and the resilient flap 22 of the seal 20 of the lower channel member 65 would face downward. Furthermore, when the illustrated cover member 16 is connected to the frame 12, the resilient flap 22 of the seal 20 of the upper channel member 62 would engage the horizontal surface 14 on the bottom face 34 of the top frame cross-member 24 or the horizontal surface 14 of the bottom face 46 of the compound middle frame cross-member 30. Likewise, the resilient flap 22 of the seal 20 of the lower channel member 65 would engage the horizontal surface 14 on the top face 38 of the bottom frame cross-member 26 or the horizontal surface 14 of the top face 44 of the compound middle frame cross-member 30. The seals 20 therefore inhibit sound from passing through the partition 10. The seals 20 can also be used, if they are translucent or opaque, to prevent the transmission of light through the partition 10. The seals 20 can be made of an elastomer or any other suitable material.

Figure 6:
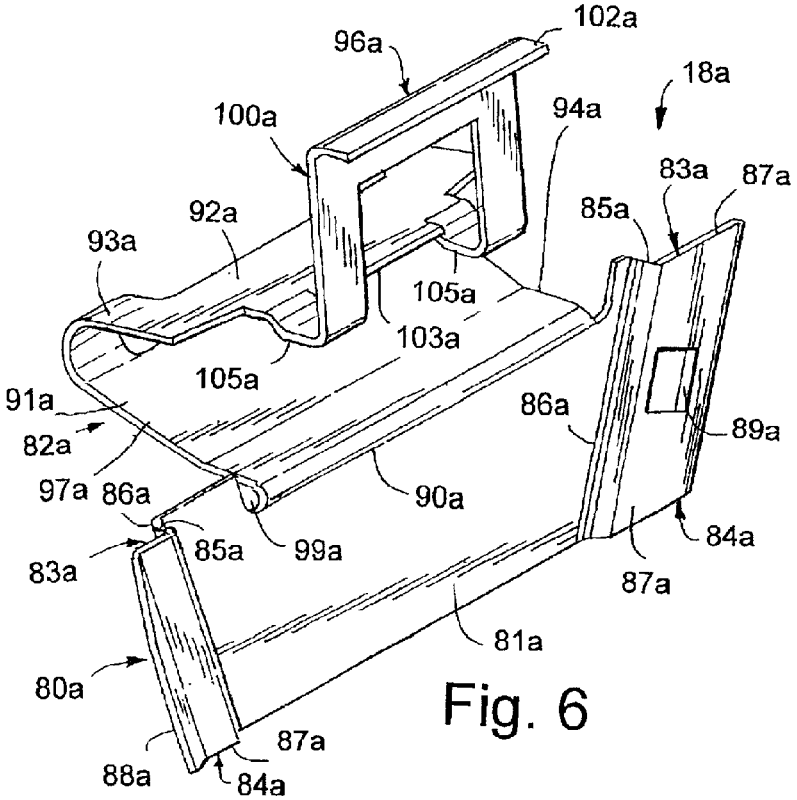
FIG. 6 is a rear isometric view of an upper attachment member of the present invention.
Figure 7:
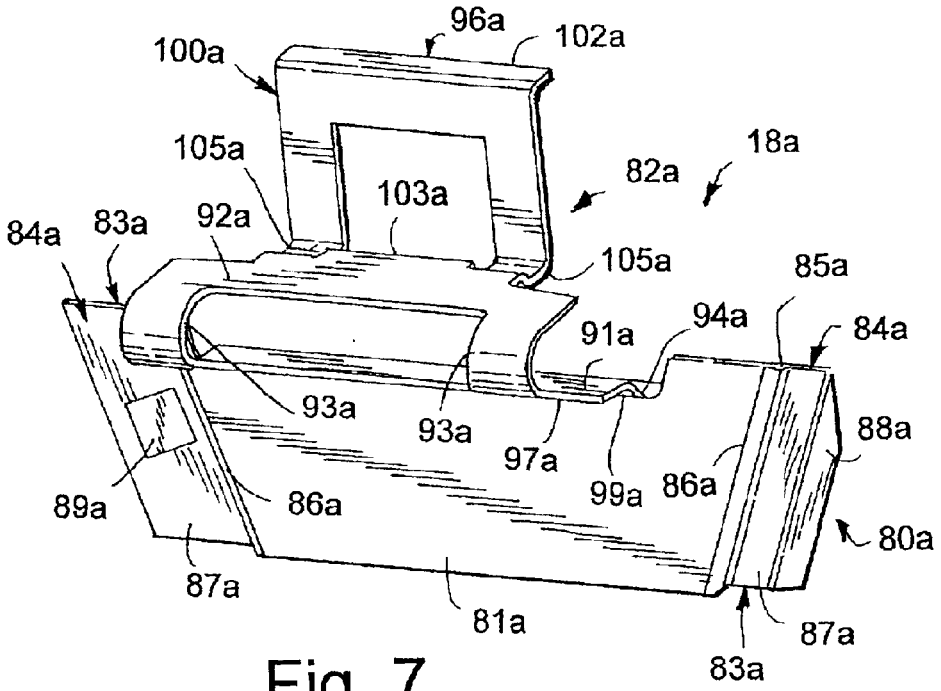
FIG. 7 is a front isometric view of the upper attachment member of the present invention.

In the illustrated example, the attachment members 18 comprise upper attachment members 18*a* connected to the upper channel member 62 of the cover member 16 and lower channel members 18*b* connected to the lower channel members 65 of the cover member 16. The upper attachment members 18*a* comprise spring clips (FIGS. 6 and 7) having a central plate 80*a* and a protruding U-shaped portion 82*a*. The central plate 80*a* includes a trapezoid shaped panel section 81*a* and a pair of side flanges 84*a*. If the slots 70 are parallel as discussed above in an alternative design of the cover member 16, the panel section 81*a* would preferably have a substantially rectangular configuration. Each side flange 84*a* includes a substantially L-shaped portion 83*a* having a first leg 85*a* extending rearward from a side edge 86*a* of the panel section 81*a* and a second leg 87*a* extending outward from the first leg 85*a*. As seen in FIGS. 6 and 7, the second leg 87*a* of one of side flanges 84*a* is longer than the second leg 87*a* of the other side flange 84*a*. The longer second leg 87*a* has a forwardly and outwardly extending detent 89*a* extending from a central portion of the longer second leg 87*a*. The shorter side flange 84*a* also includes tab portion 88*a* extending slightly rearward and outward from the second leg 87*a* of the first substantially L-shaped portion 83*a*. The first legs 85*a* of the side flanges 84*a* have approximately the same angle as the pair of slots 70 in the upper channel member 62 of the cover member 16 (see FIG. 12).

The illustrated protruding U-shaped portion 82*a* of the upper attachment member 18*a* extends substantially perpendicularly from an upper edge 90*a* of the plate 80*a*, with the protruding U-shaped portion 82*a* opening rearwardly. The U-shaped portion 82*a* includes a lower sheet 91*a*, an upper sheet 92*a*, a pair of U-shaped leaf spring locking arms 93*a* connecting the lower sheet 91*a* and the upper sheet 92*a*, and an upstanding connecting flange 96*a*. Although two leaf spring locking arms 93*a* are shown, it is contemplated that only one or several leaf spring locking arms could be used. The lower sheet 91*a* includes a first portion 94*a* extending downward and rearward from the top edge 90*a* of the plate 80*a* and a second portion 97*a* extending upward and rearward from the first portion 94*a*. As seen in FIG. 6, first portion 94*a* and the plate 80*a* define a downwardly opening channel 99*a* therebetween. The pair of U-shaped leaf spring locking arms 93*a* extend from an edge of the second portion 97*a* of the lower sheet 91*a* opposite to the first portion 94*a*. The upper sheet 92*a* is also connected to the pair of U-shaped leaf spring locking arms 93*a* and is located at a position above the lower sheet 91*a*. The upper sheet 92*a* includes a pair of U-shaped notch members 105*a* extending from a side of the upper sheet 92*a* opposite to the pair of U-shaped leaf spring locking arms 93*a*. A tab 103*a* extends between each of the U-shaped notch members 105*a*.

In the illustrated example, the upstanding connecting flange 96*a* of the upper attachment member 18*a* has an inverted U-shape as viewed from the front of the upper attachment member 18*a* and extends upward from the pair of U-shaped notch members 105*a*. The upstanding connecting flange 96*a* includes a cross portion 100*a* having an inverted L-shaped cross-section. The cross portion 100*a* includes a substantially horizontal section 102*a* extending rearward. The protruding U-shaped portion 82*a* assists in connecting the cover member 16 to the frame 12.

Figure 8:
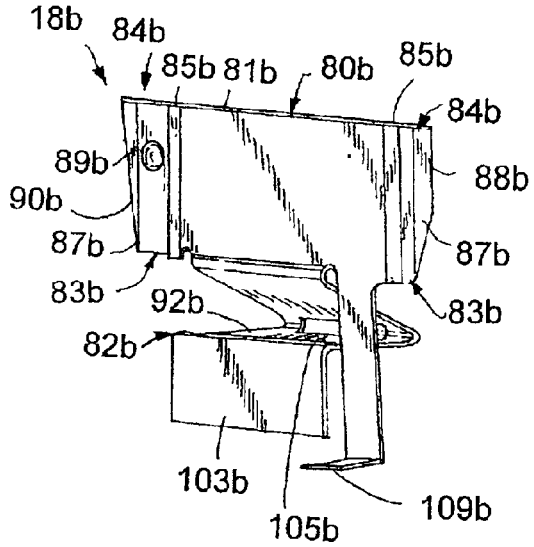
FIG. 8 is a rear isometric view of a lower attachment member of the present invention.
Figure 9:
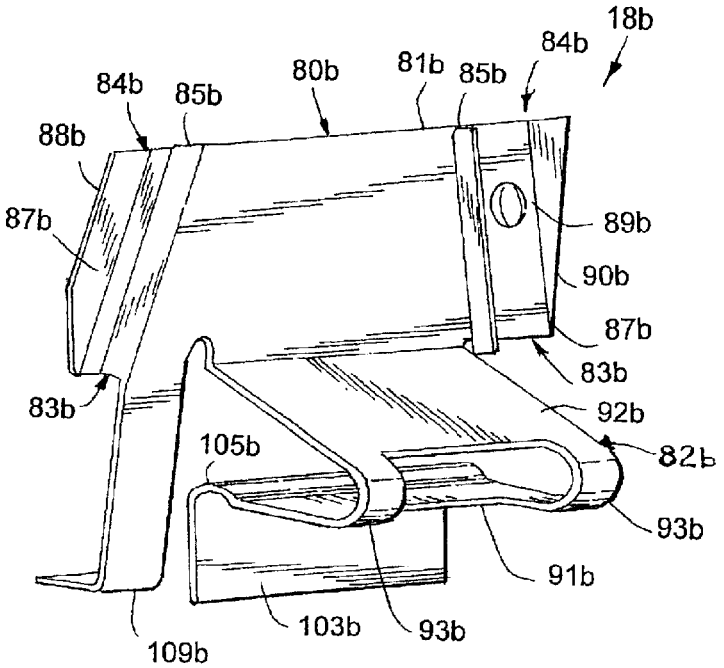
FIG. 9 is a front isometric view of the lower attachment member of the present invention.

The illustrated lower attachment members 18*b* (FIGS. 8 and 9) are similarly configured to the upper attachment members 18*a* and also comprise spring clips having a central plate 80*b* and a protruding U-shaped portion 82*b*. The central plate 80*b* includes a trapezoid shaped panel section 81*b* and a pair of side flanges 84*b*. If the slots 70 are parallel as discussed above in an alternative design of the cover member 16, the panel section 81*b* would preferably have a substantially rectangular configuration. Each side flange 84*b* includes a substantially L-shaped portion 83*b* having a first leg 85*b* extending rearward from a side edge 86*b* of the panel section 81*b* and a second leg 87*b* extending outward from the first leg 85*b*. As seen in FIGS. 8 and 9, the second leg 87*b* of one of side flanges 84*b* is longer than the second leg 87*b* of the other side flange 84*b*. The longer second leg 87*b* has outwardly extending detent 89*b* extending from a central portion of the longer second leg 87*b*. The shorter side flange 84*b* also includes tab portion 88*b* extending rearward and outward from the second leg 87*b* of the first substantially L-shaped portion 83*b*. The first legs 85*b* of the side flanges 84*b* have approximately the same angle as the pair of slots 70 in the lower channel member 65 of the cover member 16. The central plate 80*b* also includes an L-shaped tab 109*b* extending downward from one side of a lower edge 90*b* of the plate 80*b*. As explained in more detail below, the L-shaped tab 109*b* assists in removing the lower attachment members 18*b* from the frame 12.

In the illustrated example, the protruding U-shaped portion 82*b* of the lower attachment member 18*b* extends from the lower edge 90*b* of the plate 80*b*, with the protruding U-shaped portion 82*b* opening rearwardly. The U-shaped portion 82*b* includes a lower sheet 91*b*, an upper sheet 92*b*, a pair of U-shaped leaf spring locking arms 93*b* connecting the lower sheet 91*b* and the upper sheet 92*b*. The upper sheet 92*b* extends downwardly and forwardly from the lower edge 90*b* of the sheet 91*b*. The pair of U-shaped leaf spring locking arms 93*b* extend downward from an edge of the upper sheet 92*b* opposite to the lower edge 90*b* of the sheet 91*b*. The lower sheet 91*b* is also connected to the pair of U-shaped leaf spring locking arms 93*b* and is located at a position below the upper sheet 92*b*. The lower sheet 91*b* includes an elongated notch member 105*b* extending from a side of the lower sheet 91*b* opposite to the pair of U-shaped leaf spring locking arms 93*b*. A tab 103*b* extends downwardly from the elongated notch member 105*b*. The protruding U-shaped portion 82*b* assists in connecting the cover member 16 to the frame 12.

Figure 10:
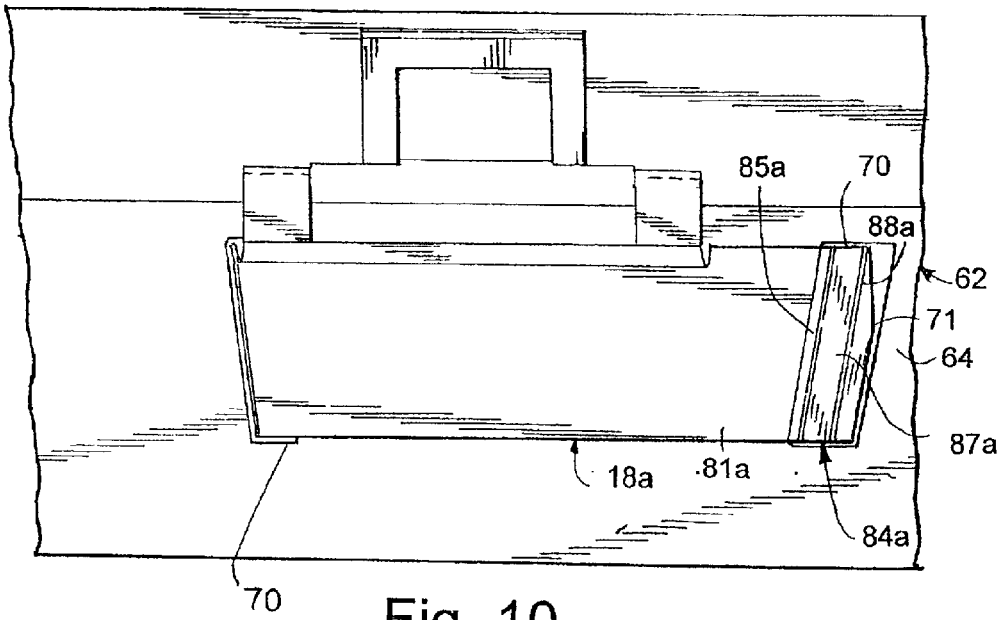
FIG. 10 is a rear partial view of the upper attachment member in the cover member at a first position.
Figure 11:
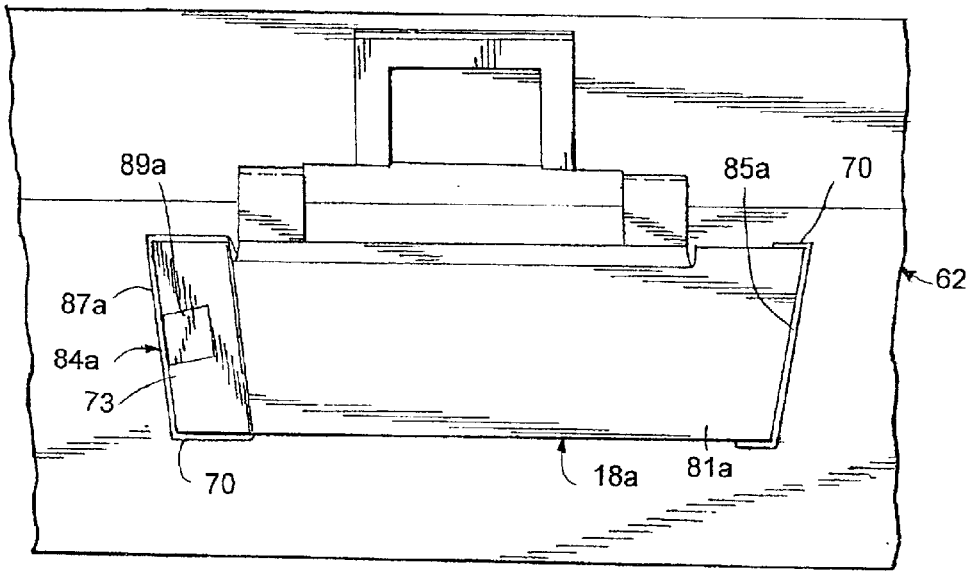
FIG. 11 is a rear partial view of the upper attachment member in the cover member at a second position.

In the preferred embodiment, the upper attachment members 18*a* are connected to the cover member 16 by first inserting the side flange 84*a* with the longer second leg 87*a* fully into one of the slots 70 in the intermediate L-shaped flange 64 of the upper channel member 62. Once the side flange 84*a* with the longer second leg 87*a* is fully inserted into one of the slots 70, the side flange 84*a* with the shorter second leg 87*a* can fit into the other slot 70 (see FIG. 10). The panel section 81*a* will be flush against the intermediate L-shaped flange 64 at this point. The upper attachment member 18*a* is then shifted laterally in the direction of the side flange 84*a* with the shorter second leg 87*a* until the first leg 95*a* of the side flange 84*a* with the shorter second leg 87*a* abuts against an outside edge 71 of the slot 70. As seen in FIG. 11, when the side flange 84*a* with the shorter second leg 87*a* is fully inserted into the slot 70, the forwardly and outwardly extending detent 89*a* extending from the central portion of the longer second leg 87*a* will snap outward to abut against an outside edge 73 of the other of the slots 70 to maintain the upper attachment member 18*a* in position in the cover member 16. Because the slots 70 are angled as discussed above, the upper attachment members 18*a* will only fit into the slots 70 with the protruding U-shaped sections 82*a* of the upper attachment members 18*a* in the proper position for connecting the cover member 16 to the frame 12. Therefore, the two upper attachment members 18*a* adjacent the upper edge of the cover member 16 will have the protruding U-shaped section 82*a* above the central plate 80*a*.

In the preferred embodiment, the lower attachment members 18*b* are connected to the cover member 16 in the same manner as the upper attachment members 18*a*. Therefore, the lower attachment members 18*b* are connected to the cover member 16 by first inserting the side flange 84*b* with the longer second leg 87*b* fully into one of the slots 70 in the intermediate L-shaped flange 64 of the lower channel member 65. Once the side flange 84*b* with the longer second leg 87*b* is fully inserted into one of the slots 70, the side flange 84*b* with the shorter second leg 87*b* can fit into the other slot 70. The panel section 81*b* will be flush against the intermediate L-shaped flange 64 at this point. The lower attachment member 18*b* is then shifted laterally in the direction of the side flange 84*b* with the shorter second leg 87*b* until the first leg 95*b* of the side flange 84*b* with the shorter second leg 87*b* abuts against an outside edge of the slot 70. When the side flange 84*b* with the shorter second leg 87*b* is fully inserted into the slot 70, the forwardly and outwardly extending detent 89*b* extending from the central portion of the longer second leg 87*b* will snap outward to abut against an outside edge of the other of the slots 70 to maintain the lower attachment member 18*b* in position in the cover member 16. Because the slots 70 are angled as discussed above, the lower attachment members 18*b* will only fit into the slots 70 with the protruding U-shaped sections 82*b* of the lower attachment members 18*b* in the proper position for connecting the cover member 16 to the frame 12. Therefore, the two lower attachment members 18*b* adjacent the bottom edge of the cover member 16 will have the protruding U-shaped section 82*b* below the central plate 80*b*.

Figure 14:
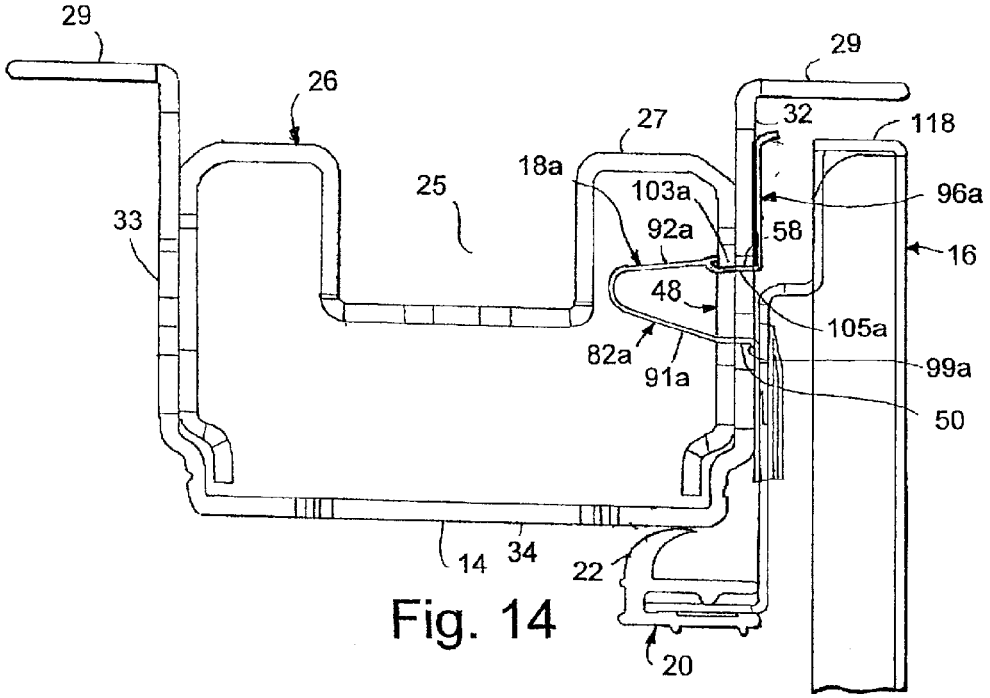
FIG. 14 is a cross-sectional partial view of the seal, a top frame cross-member of the frame, the cover member and the attachment member of the present invention.

The illustrated upper attachment members 18*a* connect the cover member 16 to the frame 12 by inserting the protruding U-shaped sections 82*a* into the oval-shaped windows 48 on the frame 12 (see FIGS. 13 and 14). In the illustrated example, one cover member 16 will enclose an upper portion 113 (see FIG. 2) of the frame 12 between the top frame cross-member 26 and the middle compound frame cross-member 30 and one cover member 16 will enclose a lower portion 114 (see FIG. 2) of the frame 12 between the middle compound frame cross-member 30 and the bottom frame cross member 28. The cover member 16 enclosing the upper portion 113 of the frame 12 will have two of its attachment members 18*a* inserted into the oval-shaped windows 48 in the front face 32 of the top frame cross member 26 and two of its attachment members 18*b* inserted into the oval-shaped windows 48 in the upper front face 40 of the middle compound frame cross-member 30. Likewise, the cover member 16 enclosing the lower portion 114 of the frame 12 will have two of its attachment members 18*a* inserted into the oval-shaped windows 48 in the lower front face 42 of the middle compound frame cross-member 30 and two of its attachment members 18*b* inserted into the oval-shaped windows 48 in the bottom frame cross-member 28.

The illustrated cover member 16 is connected to the frame by first inserting the protruding U-shaped portions 82 of the lower attachment members 18*b* into the oval-shaped windows 48 in either the front face 36 or the back face of the lower frame cross member to enclose the lower portion 114 of the frame 12, or the upper front face 40 or the upper back face 41 of the middle compound frame cross member to enclose the upper portion 113 of the frame 12 (see, e.g. FIG. 13). As the protruding U-shaped portions 82*b* of the lower attachment members 18*b* are inserted into the oval-shaped windows 48, the upper sheet 92*b* and the lower sheet 91*b* have a maximum distance therebetween longer than the distance between the top edge 58 and the bottom edge 50 of the oval-shaped windows 48. Therefore, the upper sheet 92*b* and the lower sheet 91*b* will flex towards each other, with the pair of U-shaped leaf spring locking arms 93*b* biasing the upper sheet 92*b* and the lower sheet 91*b* away from each other. When the protruding U-shaped portion 82*b* of the lower attachment member 18*b* is fully inserted into the oval-shaped windows 48, the lower sheet 91*b* will snap downward and the bottom edge 50 of the oval-shaped window 48 will rest in the elongate notch member 105*b*. Furthermore, the upper sheet 92*b* will snap upward.

The illustrated cover member 16 is then fully attached to the frame 12 by rotating an upper portion of the cover member 16 towards the frame 12 to insert the upper attachment members 18*a* into the frame 12. The upper attachment members 18*a* connect the cover member 16 to the frame 12 by first inserting the protruding U-shaped portions 82*a* of the upper attachment members 18*a* into the oval-shaped windows 48 to connect the cover member 16 to the frame 12 (FIGS. 13 and 14). As the protruding U-shaped portions 82*a* of the upper attachment members 18*a* are inserted into the oval-shaped windows 48, the upper sheet 92*a* and the lower sheet 91*a* have a maximum distance therebetween longer than the distance between the top edge 58 and the bottom edge 50 of the oval-shaped windows 48. Therefore, the upper sheet 92*a* and the lower sheet 91*a* will flex towards each other, with the pair of U-shaped leaf spring locking arms 93*a* biasing the upper sheet 92*a* and the lower sheet 91*a* away from each other. When the protruding U-shaped portion 82*a* of the upper attachment member 18*a* is fully inserted into the oval-shaped windows 48, the upper sheet 92*a* will snap upward and the top edge 58 of the oval-shaped window 48 will rest in the pair of U-shaped notch members 105*a*. Likewise, the lower sheet 91*a* will snap downward and the bottom edge 50 of the oval-shaped window 48 will rest in the downwardly opening channel 99*a* of the upper attachment member 18*a*. Furthermore, the tab 103*a* will snap behind the respective face of the frame cross-member. Therefore, the upper attachment members 18*a* will be positively locked within the oval-shaped windows 48 to connect the cover member 16 to the frame 12. Accordingly, the cover member 16 will be connected to the frame 12 by the upper attachment members 18*a* and the elongated notch 105*b* of the lower attachment members 18*b*. As described in more detail below, the upstanding connecting flange 96*a* is depressed to remove the upper attachment members 18*a* from the oval-shaped windows 48.

Figure 15:
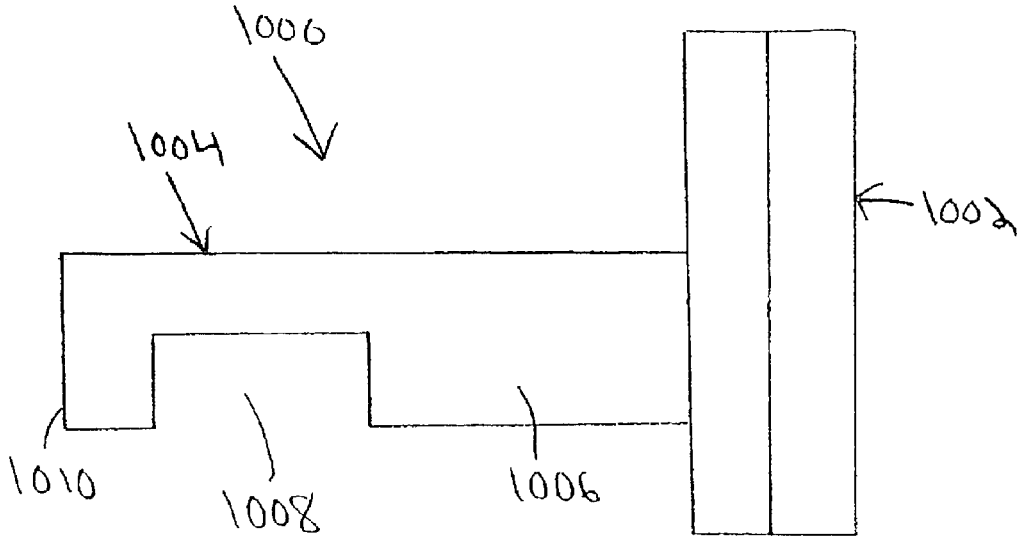
FIG. 15 is a perspective view of a tool used to remove the upper attachment members from the frame of the present invention.

In the illustrated example, a tool 1000 preferably is used to remove the upper attachment members 18*a* from the oval-shaped windows 48. The tool 1000 (FIG. 15) includes a handle 1002 and a key portion 1004. The key portion 1004 of the tool 1000 includes a main portion 1006 with a rectangular notch 1008 adjacent the end of the key portion 1004. The notch 1008 defines an end flange 1010 located at the end of the key portion 1004. As seen in FIG. 13, the illustrated upper attachment members 18*a* are removed from the oval-shaped windows 48 in the middle compound frame cross-member 30 by first turning the key portion 1004 of the tool 1000 such that the key portion 1004 is substantially parallel to a horizontal plane. Thereafter, the tool 1000 is inserted between the elongated horizontal trim strip 53 and a top edge 118 of the cover member 16 covering the lower portion 114 of the frame 12. The tool 1000 is thereafter rotated such that the cover member 16 is located within the notch 1008. Furthermore, the end flange 1010 engages the horizontal section 102*a* of the connecting flange 96*a* of the upper attachment member 18*a*, and depresses the same so as to disengage the tab 103*a* from behind the cross-member. The tool 1000 is then pulled towards the user of the tool 1000 to pull the cover member 16 outward, with the end flange 1010 pulling against a rear face 119 of the cover member 16 to pull the upper attachment members 18*a* out of the oval-shaped windows 48. Preferably, the main portion 1006 of the key portion 1004 of the tool 1000 will not be fully vertical when the end flange 1010 of the key portion 1004 engages the connecting flange 96*a* of the upper attachment member 18*a* because the main portion 1006 will abut the top edge 118 of the cover member 16. Consequently, the key portion 1004 cannot be overturned and the connecting flange 96*a* of the upper attachment members 18*a* cannot be overflexed during removal of the upper attachment members 18*a* from the oval-shaped windows 48. The tool 1000 can also be inserted between the L-shaped flange 29 of the top frame cross-member 26 and the top edge 118 of the cover member 16 covering the upper portion 113 to engage and remove the upper attachment member 18*a* from the top frame cross-member 26 in the manner described directly above.

The illustrated lower attachment members 18*b* are thereafter removed from the oval-shaped windows 48 by rotating the upper portion of the cover member 16 away from the frame. As seen in FIG. 13, the L-shaped tab 109*b* abuts against the front face 36 or the back face of the lower frame cross member to enclose the lower portion 114 of the frame 12, or the upper front face 40 or the upper back face 41 of the middle compound frame cross member to enclose the upper portion 113 of the frame 12. As the cover member 16 is rotated outward, the L-shaped tab 109*b* will create a pivot point 2000 that the cover member 16 will rotate about. The pivot point 2000 will assist the upper sheet 91*b* of the lower attachment members 18*b* to move away from the top edge 58 of the oval-shaped windows 48, thereby allowing the protruding U-shaped portion 82*b* of the lower attachment members 18*b* to be removed from the oval-shaped windows 48. It is further contemplated that the lower attachment members 18*b* could be directly pulled outward to remove the protruding U-shaped portion 82*b* from the oval-shaped windows 48.

Figure 16:
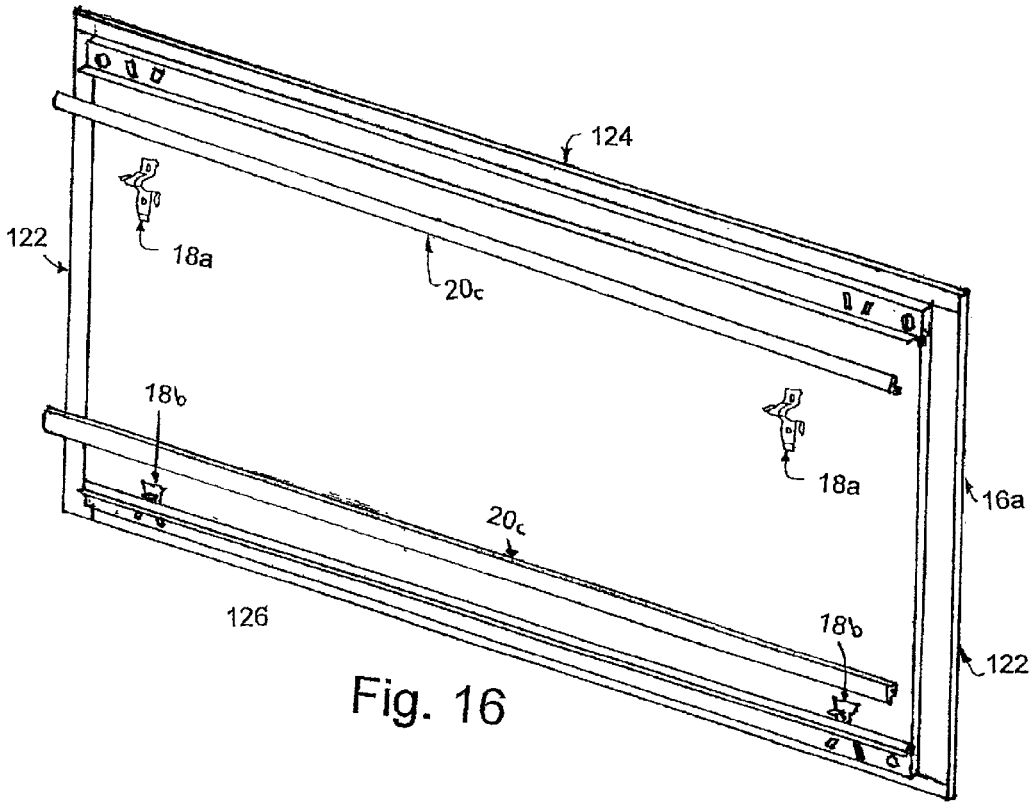
FIG. 16 is an exploded perspective view of a seal, cover member and attachment member embodying a second embodiment of the present invention.
Figure 17:
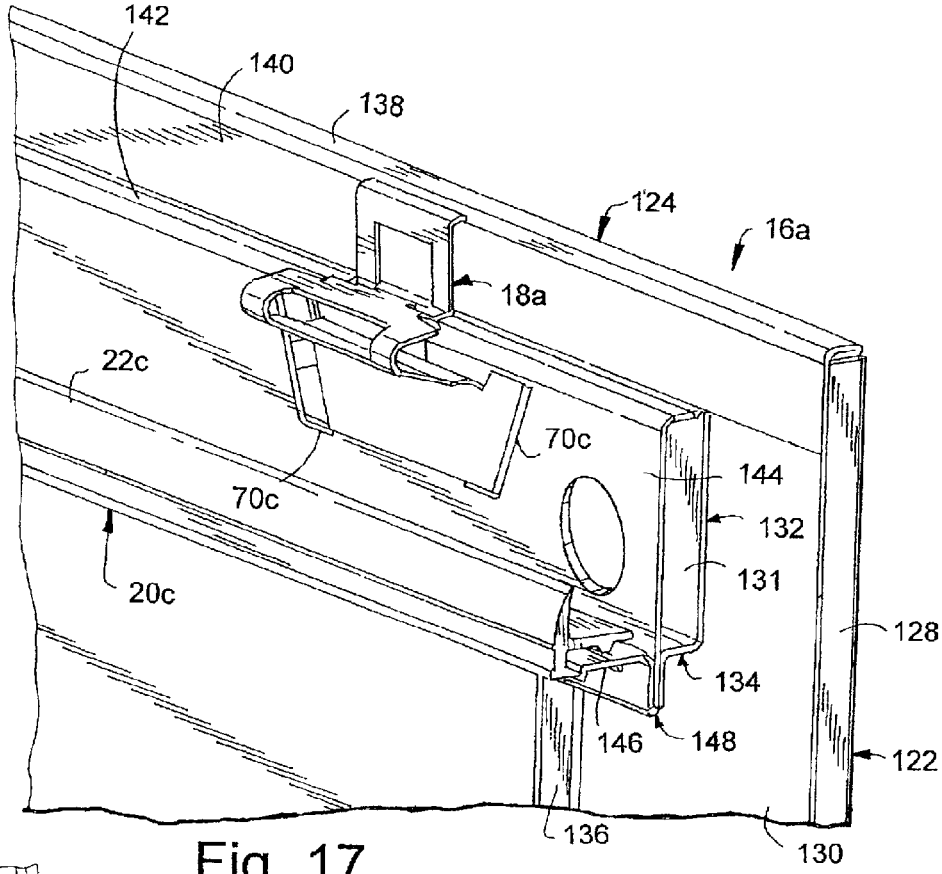
FIG. 17 is a partial rear isometric view of the seal, cover member and attachment member of the second embodiment of the present invention.

The reference numeral 16*c* (FIGS. 16–17) generally designates another embodiment of the present invention, having a second embodiment for the cover member. Since cover member 16*c* is similar to the previously described cover member 16, similar parts appearing in FIGS. 1–15 and FIGS. 16–17, respectively, are represented by the same, corresponding reference number, except for the suffix "c" in the numerals of the latter. The cover member 16*c* is preferably used to hold a tack board (not shown). The cover member 16*c* includes a pair of side rails 122, a top rail 124 and a bottom rail 126. The top rail 124 connects to the top ends of the side rails 122 and the bottom rail 126 connects to the bottom ends of the side rails 122.

In the illustrated example, the side rails 122 each have a stepped cross-section including an outside portion 128, an intermediate portion 130 substantially perpendicular to the outside portion 128 and an inside portion 136 substantially perpendicular to the intermediate portion 130. The outside portion 128 and the intermediate portion 130 extend for the length of the side rails 122. However, the inside portion 136 has a length shorter than the intermediate portion 130 and the outside portion 128 with top and bottom ends of the inside portion 136 equally distant from the ends of the side rails 122. The outside portion 128, intermediate portion 130, and the inside portion 136 abut and have portions connected to the top rail 124 and the bottom rail 126.

The illustrated top rail 124 and bottom rail 126 are identical, with the bottom rail 126 being positioned in an opposite orientation to the top rail 124. Only the top rail 124 will be described, with the understanding that the bottom rail 126 includes the same elements in an opposite orientation (e.g., upper for the top equals lower for the bottom). The top rail 124 is similar to the side rails 122 and includes an upper horizontal portion 138, a first vertical portion 140, a middle horizontal portion 142, a second vertical portion 144 and a lower horizontal portion 146. The upper horizontal portion 138 preferably is bent over in a tight U-shape to provide strength for the top rail 124. The second vertical portion 144 has a bent over bottom section 148 that is also bent over in a tight U-shape and extends first downward from the horizontal portion 142 and then upward. The second vertical portion 144 also has a pair of slots 70*c* located adjacent the ends of the second vertical portion 144 and above the bent over bottom section 148. A support flange 132 is attached behind the first vertical flange portion 140 of the top rail 124 and includes an L-shaped lower portion 134 attached behind the bent over bottom section 148 of the second vertical portion 144. Therefore, the middle horizontal portion 142, the second vertical portion 144 and the support flange 132 define a rectangular tube 131. Similar to the side rails 122, the upper horizontal portion 138 and the first vertical portion 140 extend for the length of the top rail 124. Furthermore, the middle horizontal portion 142, the second vertical portion 144 and the lower horizontal portion 146 have a length shorter than the upper horizontal portion 138 and the first vertical portion 140, with side ends equally distant from the ends of the top rail 124. In the preferred embodiment, the top rail 124 is connected to the side rails 122 by placing the upper horizontal portion 138 of the top rail 124 over the top edge of the outside portion 128 of the side rails 122 and overlapping the first intermediate portion 130 of the side rails 122 over the side face of the first vertical portion 140 of the top rail 124.

The attachment members 18*c* are connected to the cover member 16*c* by inserting each attachment member 18*c* into one of the pair of slots 70*s* as described in the first embodiment. The lower attachment members 18*b* are connected to the bottom rail 126 in a like manner. Furthermore, the seal 20*c* is connected to the lower horizontal portion 146 in the same manner as the connection between the seal 20 and the lower flange 68 of the first embodiment. The cover member 16*c* can then be attached to the frame 12*c* as discussed above, with the resilient flap 22*c* of the seal 20*c* engaging the horizontal surface 14*c* of the frame 12*c*.

Figure 18:
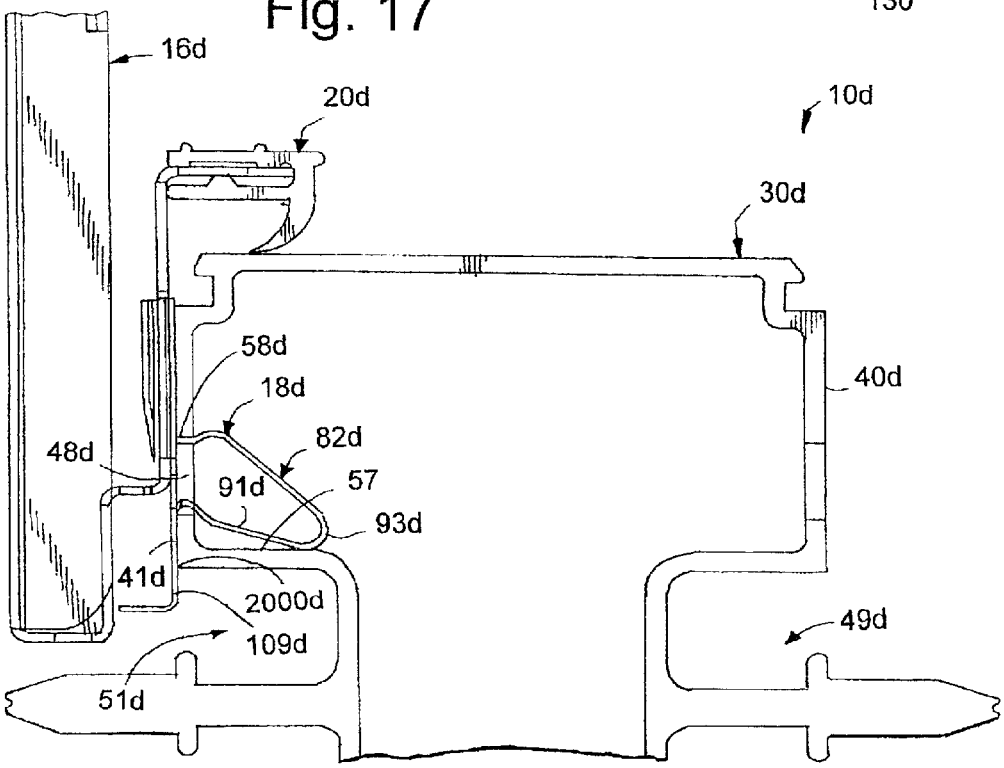
FIG. 18 is a cross-sectional partial view of the seal, middle compound frame cross-member of the frame, the cover member and attachment members of a third embodiment of the present invention.

The reference numeral 10*d* (FIG. 18) generally designates another embodiment of the present invention, having a second embodiment for the partition. Since partition 10*d* is similar to the previously described partition, similar parts appearing in FIGS. 1–15 and FIG. 18, respectively, are represented by the same, corresponding reference number, except for the suffix "d" in the numerals of the latter. The compound middle frame cross-member 30*d* of the present invention is similar to the compound middle frame cross-member 30 of the first embodiment of the present invention, except that the compound middle frame cross-member 30*d* has a substantially I-shaped cross-section. The compound middle frame cross-member 30*d* includes an outwardly facing channel 49*d* located between the upper front face 40*d* and the lower front face. Likewise, an inwardly facing channel 51*d* is located between the upper back face 41*d* and the lower back face. The elongated horizontal trim strip 53*d* extending out of the middle of each of the channels 49*d* and 51*d* has a chevron shaped cross-section. The compound middle frame cross-member 30*d* is substantially a mirror image above and below a line extending through the horizontal midpoint of the elongated horizontal trim strip 53*d*.

In the illustrated example, the protruding U-shaped section 82*d* of the lower attachment member 18*d* is angled downward such that a portion of the protruding U-shaped section 82*d* adjacent the pair of U-shaped leaf spring locking arms 93*d* and an edge of the lower sheet 91*d* abuts an interior surface 57 of the compound middle frame cross-member 30*d* above the inwardly facing channel 51*d*. As the cover member 16*d* is rotated outward, the L-shaped tab 109*d* of the lower attachment member 18*d* will create a pivot point 2000*d* that the cover member 16*d* will rotate about. The pivot point 2000*d* will assist the upper sheet 91*d* of the lower attachment members 18*d* to move away from the top edge 58*d* of the oval-shaped windows 48*d*, thereby allowing the protruding U-shaped portion 82*d* of the lower attachment members 18*d* to be removed from the oval-shaped windows 48*d*. In the illustrated example, the pivot point 2000*d* is located at a corner defined by the upper back face 41*d* and the inwardly facing channel 51*d*.

The above description is considered that of the preferred embodiments only. Modification of the invention will occur to those skilled in the art and to those who make or use the invention. For example, it is contemplated that a lock member could be attached to the cover member 16 for locking the cover member 16 to the frame 12 when the cover member 16 is connected to the frame 12. The lock member could extend from a rear face of the cover member 16 and engage a bottom face of one of the cross-members of the frame. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A partition for open building space, comprising:

a frame including at least one substantially horizontal surface;

a cover member being configured to enclose at least a portion of said frame said cover member including attachment members configured to connect said cover member to said frame; and a seal attached to said cover member, and including a resilient flap which engages said through said partition;

wherein said at least one substantially horizontal surface comprises a first substantially horizontal surface and a second substantially horizontal surface, said seal engaging said first substantially horizontal surface;

and further including a second seal attached to said cover member, said second seal including a resilient flap configured to engage said second substantially horizontal surface of said frame.

2. The partition as set forth in claim 1, wherein:

said cover member includes a substantially horizontal flange extending between side edges of said cover member; and said seal includes a U-shaped groove, said U-shaped groove configured to accept said substantially horizontal flange of said cover member to frictionally connect said seal to said cover member.

3. The partition as set forth in claim 2, wherein:

said seal includes at least one finger extending into said U-shaped groove, said at least one finger configured to frictionally engage said horizontal flange of said cover member.

4. The partition as set forth in claim 1, wherein:

said frame further includes a substantially horizontally extending cross-member having a plurality of windows; and said attachment members are inserted into said windows for attaching said cover member to said frame.

5. The partition as set forth in claim 4, wherein:

said at least one substantially horizontal surface is located on a lower portion of said cross-member.

6. A partition for open building spacer, comprising:

a frame including at least one substantially horizontal surface;

a cover member being configured to enclose at least a portion of said frame, said cover member including attachment members configured to connect said cover member to said frame; and a seal attached to said cover member, and including a resilient flap which engages said substantially horizontal surface of said frame to inhibit the passage of acoustical energy through said partition;

wherein said frame further includes a substantially horizontally extending cross-member having a plurality of windows;

wherein said attachment members are inserted into said windows for attaching said cover member to said frame;

wherein said cover member includes a substantially vertical flange having a pair of angled slots; and wherein said attachment members comprise spring clips, each spring clip including a central plate having a pair of side flanges inserted into one of said pair of slots to connect said attachment member to said cover member.

7. The partition as set forth in claim 6, wherein:

each of said windows of said frame includes a top edge and a bottom edge;

at least one of said spring clips further includes a tab;

said at least one of said spring clips is connected to said cross-member by inserting said at least one of said spring clips into one of said windows, wherein said tab of said at least one of said spring clips locks against an inside surface of said cross-member above said top edge of said window to connect said at least one of said spring clips to said cross-member.

8. The partition as set forth in claim 7, wherein:

said at least one of said spring clips includes a connecting flange that extends above an upper edge of said cover member, wherein a tool can be inserted in a space located between said upper edge of said cover member and an outwardly protruding member of said frame located above said cover member so as to engage said connecting flange of said at least one of said spring clips and depress said connecting flange so as to disengage said tab of said at least one of said spring clips from said inside surface of said cross-member to disengage said at least one of said spring clips from its associated window.

9. The partition as set forth in claim 6, wherein:

said spring clips have only one orientation wherein said pair of side flanges can fit into said pair of slots.

10. The partition as set forth in claim 1, wherein:

said cover member is comprised of steel.

11. The partition as set forth in claim 1, wherein:

said cover member is comprised of wood.

12. A cover panel for a partition having a frame with a horizontal surface, said cover panel comprising:

a cover member being configured to enclose at least a portion of the frame, said cover member including attachment members configured to connect said cover member to the frame; and a seal attacked to said cover member, and including a resilient flap configured to engage the horizontal surface of the frame when said cover member is connected to the frame to inhibit the passage of acoustical energy through said partition;

wherein said cover member includes a substantially horizontal flange extending between side edges of said cover member; and wherein said seal includes a U-shaped groove, said U-shaped groove configured to accept said substantially horizontal flange of said cover member to frictionally connect said seal to said cover member.

13. The cover panel as set forth in claim 12, wherein:

said seal includes at least one finger extending into said U-shaped groove, said at least one finger configured to frictionally engage said horizontal flange of said cover member.

14. The cover panel as set forth in claim 12, further including:

a second seal attached to said cover member, said second seal including a resilient flap configured to engage a second surface of the frame.

15. The cover panel as set forth in claim 12, wherein:

said attachment members are configured to be inserted into windows on a substantially horizontal cross-member of the frame for attaching said cover member to the frame.

16. A cover panel for a partition having a frame with a horizontal surface, said cover panel comprising:

a cover member being configured to enclose at least a portion of the frame, said cover member including attachment members configured to connect said cover member to the frame; and a seal attached to said cover member, and including a resilient flap configured to engage the horizontal surface of the frame when said cover member is connected to the frame to inhibit the passage of acoustical energy through said partition;

wherein said attachment members are configured to be inserted into windows on a substantially horizontal cross-member of the frame for attaching said cover member to the frame;

wherein said cover member includes a substantially vertical flange having a pair of angled slots; and wherein said attachment members comprise spring clips, each spring clip including a central plate having a pair of side flanges inserted into one of said pair of slots to connect said attachment member to said cover member.

17. The cover panel as set forth in claim 16, wherein:

each of said spring clips further includes a tab;

said spring clip is configured to be connected to said cross-member by inserting said spring clip into one of the windows of the frame, wherein said tab of said spring clip is configured to lock against an inside surface of the cross-member above a top edge of the window to connect said spring clip to the cross-member.

18. The cover panel as set forth in claim 17, wherein:

said spring clips include a connecting flange that extends above an upper edge of said cover member, wherein a tool can be inserted in a space located between said upper edge of said cover member and an outwardly protruding member of the frame located above said cover member so as to engage said connecting flange of said spring clip and depress said connecting flange so as to disengage said tab of said attachment members from the inside surface of the cross-member to disengage said spring clip from its associated window.

19. The cover panel as set forth in claim 16, wherein:

said spring clips have only one orientation wherein said pair of side flanges can fit into said pair of slots.

20. The cover panel as set forth in claim 12, wherein:

said cover member is comprised of steel.

21. The cover panel as set forth in claim 12, wherein:

said cover member is comprised of wood.

22. The partition as set forth in claim 1, wherein:

said attachment members are removable from said cover member.

23. The partition as set forth in claim 1, wherein:

said cover member is removable from said frame.

24. The partition as set forth in claim 1, wherein:

said cover member includes a vertical flange; and said attachment members are connected to said vertical flange.

25. The cover panel as set forth in claim 12, wherein:

said attachment members are removable from said cover member.

26. The cover panel as set forth in claim 12, wherein:

said cover member includes a vertical flange; and said attachment members are connected to said vertical flange.

27. The partition as set forth in claim 4, wherein:

the substantially horizontally extending cross-member is substantially vertical.

28. The partition as set forth in claim 1, wherein:

said frame further includes at least one substantially vertical surface; and said attachment members are configured to connect said cover member to said frame by engaging said frame at said at least one substantially vertical surface.

29. A partition for open building space, comprising:

a frame including at least one substantially horizontal surface;

a cover member being configured to enclose at least a portion of said frame, said cover member including attachment members configured to connect said cover member to said frame; and a seal attached to said cover member, and including a resilient flap which engages said substantially horizontal surface of said frame to inhibit the passage of acoustical energy through said partition;

wherein said seal extends farther in a horizontal direction than one of said attachment members.

30. A partition for open building space, comprising:

a frame including a first surface and a second surface, said first surface being substantially perpendicular to said second surface;

a cover member being configured to enclose at leant a portion of said frame, said cover member including attachment members configured to connect said cover member to said frame at said first surface; and a seal attached to said cover member, and including a resilient flap which engages said second surface of said frame to inhibit the passage of acoustical energy through said partition;

wherein said first surface includes a plurality of windows; and said attachment members are inserted into said windows for attaching said cover member to said frame.

31. The partition as set forth in claim 30, wherein:

said cover member includes a flange extending between side edges of said cover member; and said seal includes a U-shaped groove, said U-shaped groove configured to accept said flange of said cover member to frictionally connect said seal to said cover member.

32. The partition as set forth in claim 31, wherein:

said seal includes at least one finger extending into said U-shaped groove, said at least one finger configured to frictionally engage said flange of said cover member.

33. The partition as set forth in claim 30, wherein:

said frame includes a third surface, the third surface being substantially parallel to the second surface;

and further including a second seal attached to said cover member, said second seal including a resilient flap configured to engage said third surface of said frame.

34. The partition as set forth in claim 30, wherein:

said second surface is located on a lower portion of said cross-member.

35. The partition as set forth in claim 30, wherein:

said cover member includes a substantially vertical flange having a pair of angled slots; and said attachment members comprise spring clips, each spring clip including a central plate having a pair of side flanges inserted into one of said pair of slots to connect said attachment member to said cover member.

36. The partition as set forth in claim 30, wherein:

said attachment members are removable from said cover member.

37. The partition as set forth in claim 30, wherein:

said cover member is removable from said frame.

38. A partition for open building space, comprising:

a frame including a first surface and a second surface, said first surface being substantially perpendicular to said second surface;

a cover member being configured to enclose at least a portion of said frame, said cover member including attachment members configured to connect said cover member to said frame at said first surface; and a seal attached to said cover member, and including a resilient flap which engages said second surface of said frame to inhibit the passage of acoustical energy through said partition;

wherein said cover member includes a vertical flange; and wherein said attachment members are connected to said vertical flange.

39. A partition for open building space, comprising:

a frame including a first surface and a second surface, said first surface being substantially perpendicular to said second surface;

a cover member being configured to enclose at least a portion of said frame, said cover member including attachment members configured to connect said cover member to said frame at said first surface; and a seal attached to said cover member, and including a resilient flap which engages said second surface of said frame to inhibit the passage of acoustical energy through said partition;

wherein said seal extends farther in a horizontal direction than one of said attachment members.

* * * * *

UNITED STATES PATENT AND TRADEMARK OFFICE

CERTIFICATE OF CORRECTION

PATENT NO. : 6,805,185 B2
DATED : October 19, 2004
INVENTOR(S) : Donald P. Gravel et al.

It is certified that error appears in the above-identified patent and that said Letters Patent is hereby corrected as shown below:

Column 13,
Line 6, “spacer” should be -- space --.

Column 15,
Line 56, “leant” should be -- least --.

Signed and Sealed this

Fifteenth Day of March, 2005

JON W. DUDAS
*Director of the United States Patent and Trademark Office*